United States Patent [19]

Arabian et al.

[11] Patent Number: 4,818,042

[45] Date of Patent: Apr. 4, 1989

[54] CLOTH TOWEL DISPENSER AND METHOD FOR THE OPERATION THEREOF

[75] Inventors: Sandro Arabian, Liechtenstein; Manfred Baumann, Diepoldsau, both of Switzerland

[73] Assignee: CWS International AG, Baar, Switzerland

[21] Appl. No.: 99,825

[22] Filed: Sep. 23, 1987

[51] Int. Cl.[4] ..... B65H 19/00

[52] U.S. Cl. ..... 312/38

[58] Field of Search ..... 312/37–39; 242/55, 53, 55.3

[56] References Cited

U.S. PATENT DOCUMENTS

| | | | |
|---|---|---|---|
| 2,175,141 | 10/1939 | Wooster | 312/38 X |
| 2,359,320 | 10/1944 | Lewis | 312/38 X |
| 2,835,645 | 5/1958 | Birr | 312/38 |
| 3,502,383 | 3/1970 | Steiner et al. | 312/38 |
| 4,243,278 | 1/1981 | Gray | 312/38 |

*Primary Examiner*—Joseph Falk

*Attorney, Agent, or Firm*—Helfgott & Karas

[57] ABSTRACT

A cloth towel dispenser incorporates at least one towel unit. Each unit is provided with a first delivery station which supports a clean towel roll having a horizontal axis. The towel roll has a leading feed edge and is adapted to be freely unrolled in successive portions. The first station includes a delivery roller rotatable about a horizontal axis and disposed adjacent the roll for unrolling it. A second draw-in station is spaced below the first station and has a take-up roller freely rotatable about a horizontal axis. The second station includes a draw-in roller rotatable about a horizontal axis to retract the successive portions of the roll onto the take-up roller. The leading edge of the roll passes in a manually extractable loop from the first station to the second station along a path which extends downwardly from the first station to a position of use disposed below the second station and then extends upwardly to the second station. A drive arrangement includes gearing and a spring tension accumulator rotatably interconnecting the delivery roller and the draw-in roller whereby the delivery and draw-in rollers rotate in the same forward direction. The delivery roller, when rotating during and after the formation of the loop, rotates and tensions the accumulator.

13 Claims, 6 Drawing Sheets

28
29
33
69
56'
57'
52
56
57
53
55
32
35
54
70
64
58
59
61
60
68'
63
62
34
30
66
67
85
68
65
10

28
43
39
71
29
40
69
38
44
72
74
75
93'
76
73
77
94
91
78
50
92
93
48
83
89
88
63
30
104
84
86
68
85
87
67
66
80

CLOTH TOWEL DISPENSER AND METHOD FOR THE OPERATION THEREOF

BACKGROUND OF THE INVENTION

The invention relates to a cloth towel dispenser comprising at least one towel unit wherein a clean towel roll is received, is unrolled in successive portions and is retracted in successive portions after use and wherein a manually extendable towel loop is employed.

Numerous different constructions of cloth towel dispensers are known. They all serve the purpose of making available a piece of cloth for drying hands which have been previously washed. In known constructions, the user pulls a piece of cloth out of the dispenser and uses same for drying the hands. A stop limits the length of the cloth portion which is pulled out. The cloth towel used for this is a belt of given length, which is used up after a number of drying operations. Whenever such a belt is changed, there is an interruption during which no towel is available for drying purposes and this time can vary as a function of the supervision of the towel dispenser. Therefore cloth towel dispensers are known, in which an interruption-free towel availability can be ensured through the use of two towel units, which become successively available. The used towel can be replaced by a clean towel in the first towel unit, while the second towel unit is available to the user.

These known constructions, however, are known to become jammed or exhibit other malfunctions from time to time whereby a user may find only a previously used length of cloth available for use although a clean length is desired.

SUMMARY OF THE INVENTION

It is a primary object of this invention to provide a new and improved cloth towel dispenser which can be operated easily in a reliable manner.

Another object is to provide a new and improved cloth towel dispenser wherein a user will always have a clean length of towel available for use.

A cloth towel dispenser in accordance with the principles of the invention incorporates at least one towel unit. Each unit is provided with a first delivery station which supports a clean towel roll having a horizontal axis. The towel roll has a leading feed edge and is adapted to be freely unrolled in successive portions. The first station includes a delivery roller rotable under a horizontal axis and disposed adjacent the roll for unrolling it. A second draw-in station is spaced below the first station and has a take-up roller freely rotatable about a horizontal axis. The second station includes a draw-in roller rotatable about a horizontal axis to retract the successive portions of the roll onto the take-up roller. The leading edge of the roll passes in a manually extractable loop from the first station to the second station along a path which extends downwardly from the first station to a position of use disposed below the second station and then extends upwardly to the second station. Drive means includes gearing and a spring tension accumulator rotatably interconnecting the delivery roller and the draw-in roller whereby the delivery and draw-in rollers rotate in the same forward direction. The delivery roller, when rotating during and after the formation of the loop, rotates and tensions the accumulator. Consequently, apart from the spring tension accumulator, no further tension source is required, because said accumulator is always tensioned during the formation of a loop.

The invention also incorporates a method for the operation of the towel dispenser, whose function is to operate the dispenser in an optimum manner. According to the invention this problem is solved in that the loop is formed by cloth delivery from the clean roll and by cloth retraction or return from the used roll, and stops are employed limiting both the cloth delivery from the delivery point and the cloth extraction from the draw-in point.

The foregoing as well as additional objects and advantages of the invention will either be explained or will become apparent to those skilled in the art when this specification is read in conjunction with the brief description of the drawings and detailed description of preferred embodiments which follow.

DETAILED DESCRIPTION OF THE PREFERRED EMBODIMENTS

Figure 1:
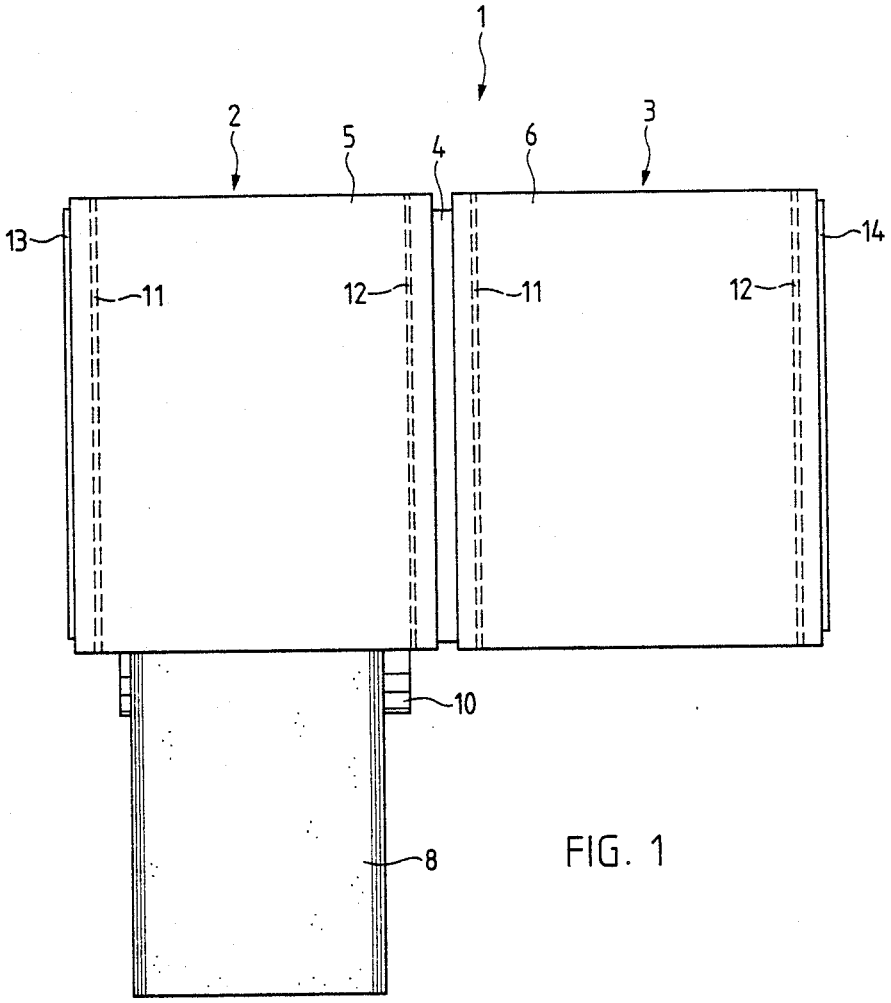
FIG. 1 front view of a cloth towel dispenser with two towel units, one unit being in operation and the other ready to operate.

The cloth towel dispenser 1 shown in FIG. 1 has two juxtaposed towel units 2 and 3 between which is arranged a narrow transition frame 4. Each of towel units 2 and 3 is essentially a parallel epipedic body whereof, viewed from the front, only the cover 5 of unit 2 and the cover 6 of unit 3 covering the casing positioned behind is visible.

Towel unit 2 is in operation and is shown with a towel loop 8 visible at the bottom of unit 2 and which can be used for drying the hands. On the bottom there is also a signal flap 10, which in the represented position permits the extraction of clean cloth towel and when the cloth reserve has been used up indicates that refilling is necessary.

In each of covers 5 and 6 there is indicated in broken line form a corresponding one of casing walls 11 and 12 within which the material transportation and formation of the loop 8 takes place. Thus, a narrow space is left between each casing and its corresponding outer cover (13 or 14 respectively) and all the drive and control elements are housed in these spaces.

Figure 2:
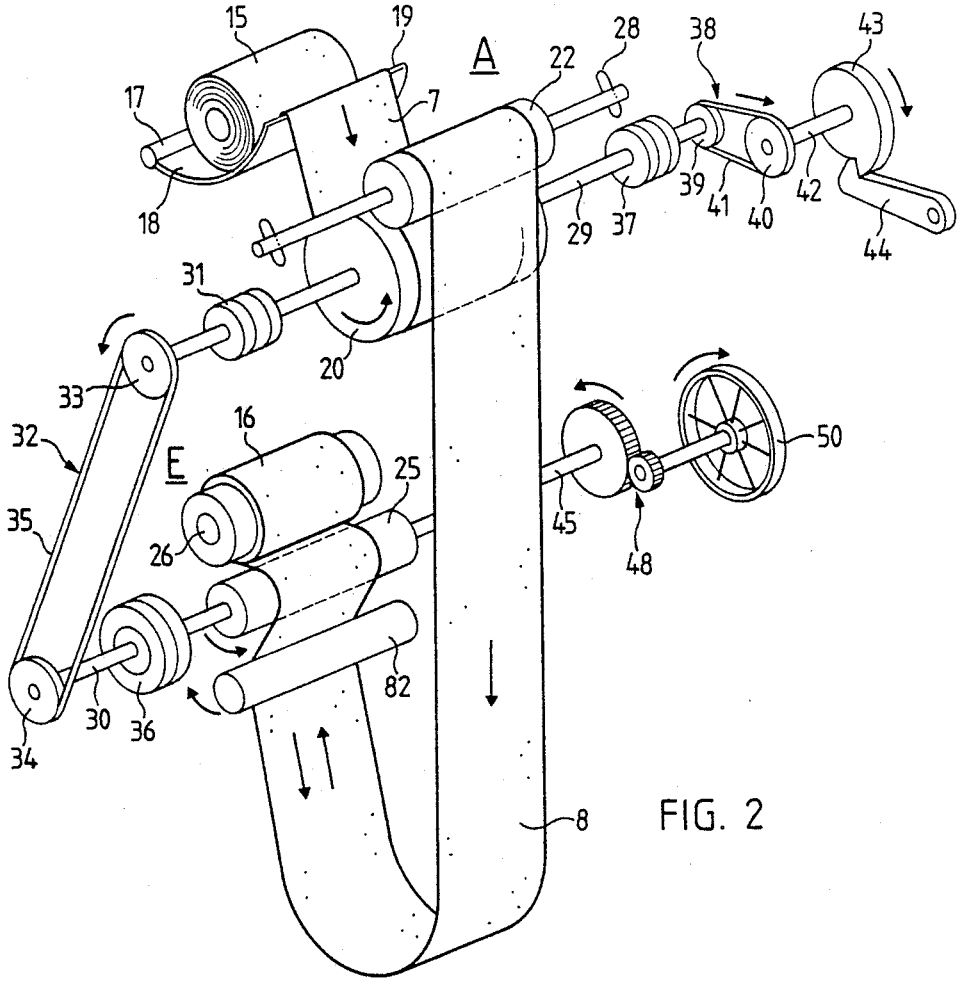
FIG. 2 is a diagrammatic representation of the essential inner parts of one towel unit three-dimensional form illustrating the delivery and draw-in stations.

In FIG. 2, A is a delivery station or point for receiving a clean towel roll 15 and E is a draw-in station or point positioned below delivery station A for receiving and rolling up the used towel roll 16.

The clean towel roll 15 is located in a roll tray or shell 18, which can be pivoted about a spindle 17 and which is drawn upwards by applied spring tension to the extent permitted by roll 15. The cloth towel 7 delivered from roll 15 is guided via the free edge 19 of roll shell 18 about a delivery roll 20, which is provided with a rough surface and then over a pressure roller 22, the cloth 7 extending within the cover downwards to the signal flap 10 (not shown in FIG. 2) and then upwards to the draw-in station E. The hands can be dried after extracting loop 8.

In the draw-in station E, the used up cloth towel is guided by means of a draw-in roller 25, which also has a rough surface, when the used towel roll 16 is drawn onto a mandrel 26, which is guided in a guide groove located in casing walls 11, 12 and can therefore give way in accordance with the increasing diameter of roll 16.

At delivery station A, the pressure roller 22 is guided in guide slots 28. As a result of the cloth guidance, during the formation of loop 8, the delivery roller 20 is pressed and reliably rotated.

Delivery roller 20 is fixed to a delivery shaft 29 and draw-in roller 25 to a draw-in shaft 30. By means of a slip clutch 31, the delivery roller 29 drives an envelope drive 32, which comprises a driving gear 33, a driven gear 34, and an envelope member 35, such as a toothed belt, the driven gear 34 being fixed to the draw-in shaft 30. The latter is connected by means of a spring tension accumulator 36 to the draw-in roller 25. The slip clutch 31 could be placed on draw-in shaft 30 instead of on delivery shaft 29.

At the other end of the delivery roller 20, the delivery shaft 29 drives, by means of a slip clutch 37, an envelope drive 38, which comprises a driving pinion 39, a driven gear 40 and an envelope member 41. The driven gear 40 is located on a shaft 42 with a cam disk 43, which cooperates with a retaining pawl 44. Cam disk 43 and retaining pawl 44 limit the cloth length during the extraction of said cloth towel 7 for the formation of loop 8. Retaining pawl 44 is released by a timer, which will be described with reference to FIG. 4.

Figure 7:
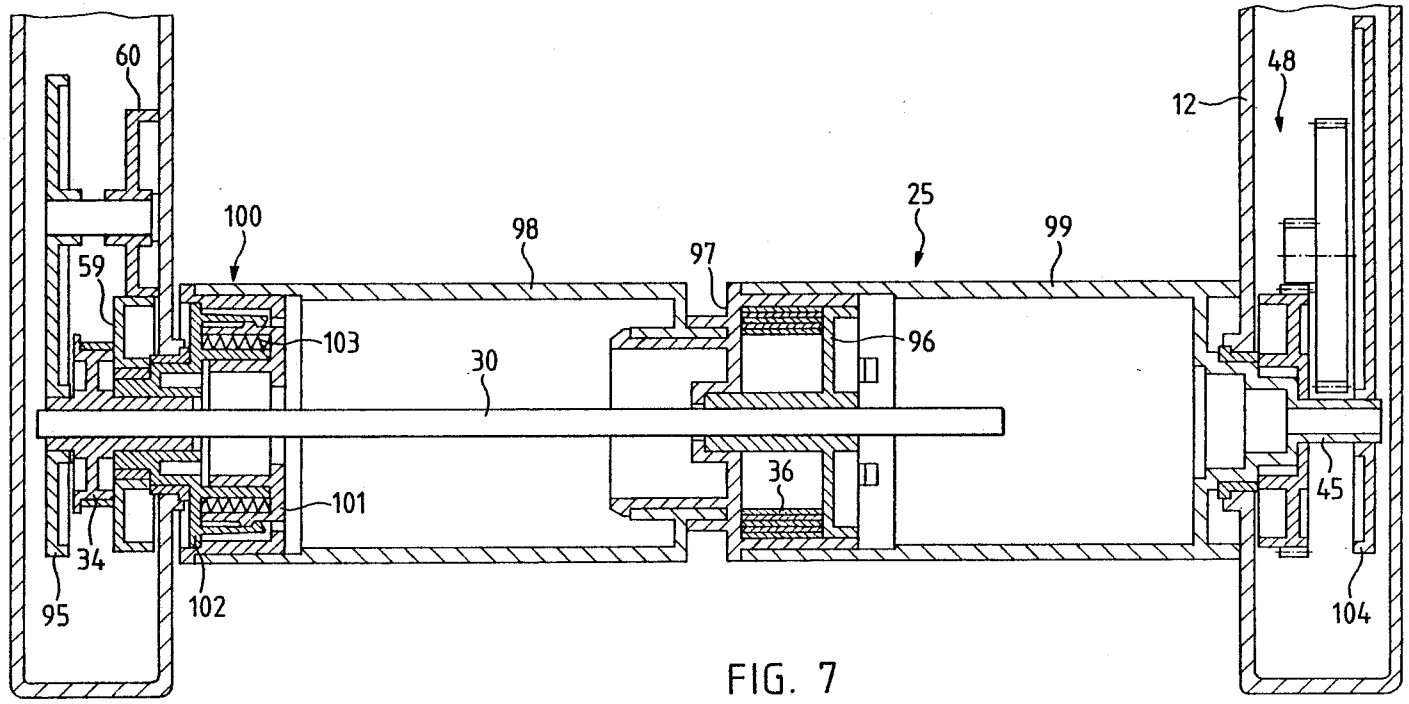
FIG. 7 is a section through the draw-in roller in a draw-in station of a towel unit.

On the side of the draw-in roller 25 remote from the spring tension accumulator 36 cf. FIG. 7, a draw-in shaftpart 45 is connected to a multi-step gear 48 (only one step shown), by means of which is driven at a very high speed a brake wheel 50. The function of brake wheel 50 is to prevent release of the spring tension accumulator 36 when the towel unit is open and to block the draw-in shaft 30 on switching on a timer.

Figure 3:
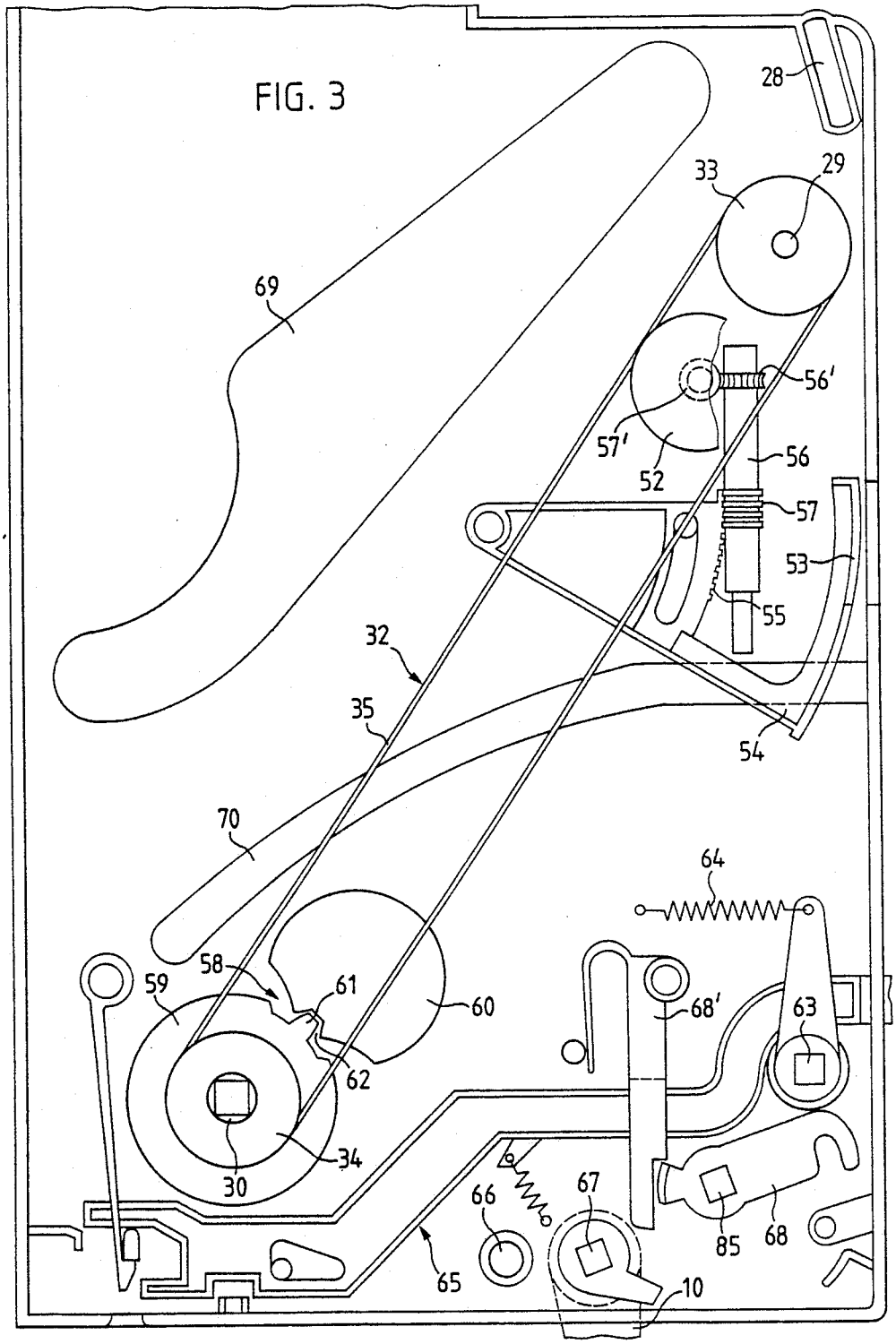
FIG. 3 is a diagrammatic exploded perspective view of the inner parts of the towel unit and illustrating one side wall of the casing of the unit.

FIG. 3 is an exploded perspective view of the inner parts of the towel unit and the casing wall 11. The reference numerals coinciding with those of FIG. 2 designate the same parts.

Envelope drive 32, as well as the intermediate gear 52, which is part of the towel content indicator 53, extend approximately diagonally. Arm 54 connected to the content indicator 53 has a tooth system 55, which cooperates with a worm 57 fixed to a shaft 56. Shaft 56 is connected by means of a further worm gear 56', 57' to the intermediate gear 52. As soon as the towel is extracted for forming a loop 8, the content indicator 53 is also adjusted. With the driven gear 34 on draw-in shaft 30 is associated a locking mechanism 58 with two disks 59, 60 having a Maltese cross-like engagement and whose disk 59 has a cam 61 and whose disk 60 has a groove 62.

A shaft 63 tensioned by a spring 64 traverses the casing and forms a sensor for establishing the presence of cloth. Between the sensor and a web located on the cover passes a towel and also extends around the signal flap (FIG. 1).

Figure 5:
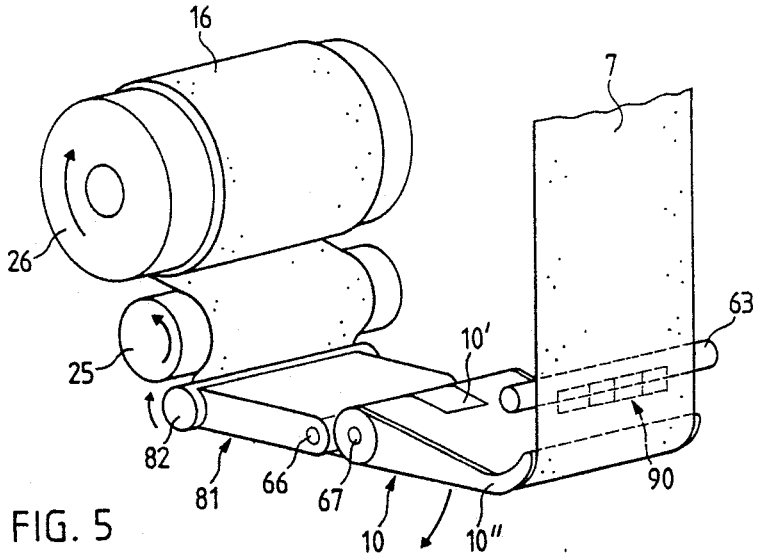
FIG. 5 is a diagrammatic representation of the draw-in station of a towel unit with a signal flap and a bottom flap in three-dimensional form.
Figure 6:
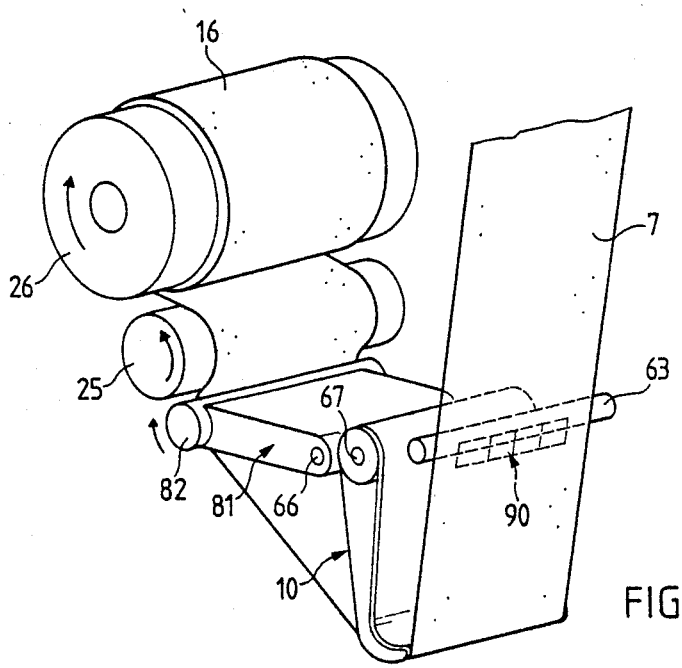
FIG. 6 shows the draw-in station according to FIG. 5 illustrating a swung out signal flap.

A locking rod 65 is provided which, on opening the cover, releases a bottom flap 81, cf. FIGS. 5 and 6. The flap has a rotation spindle 66 which is positioned alongside the rotation spindle 67 of signal flap 10. Locking rod 65 prevents the closing of the towel unit. If cover 5, 6 is to be closed, it is initially necessary to re-engage the bottom flap 81, cover 5, 6 must be pressed against the casing and a locking hook 68 with a key (not shown) must be pivoted into the closed position, the locking hook co-operating with a locking member 68'.

Reference numerals 69 and 70 designate protuberances in the casing wall 11 and on the inside there are depressions for the housing of the spring of roll shell 18 for guiding the mandrel 26 in the draw-in point E.

Figure 4:
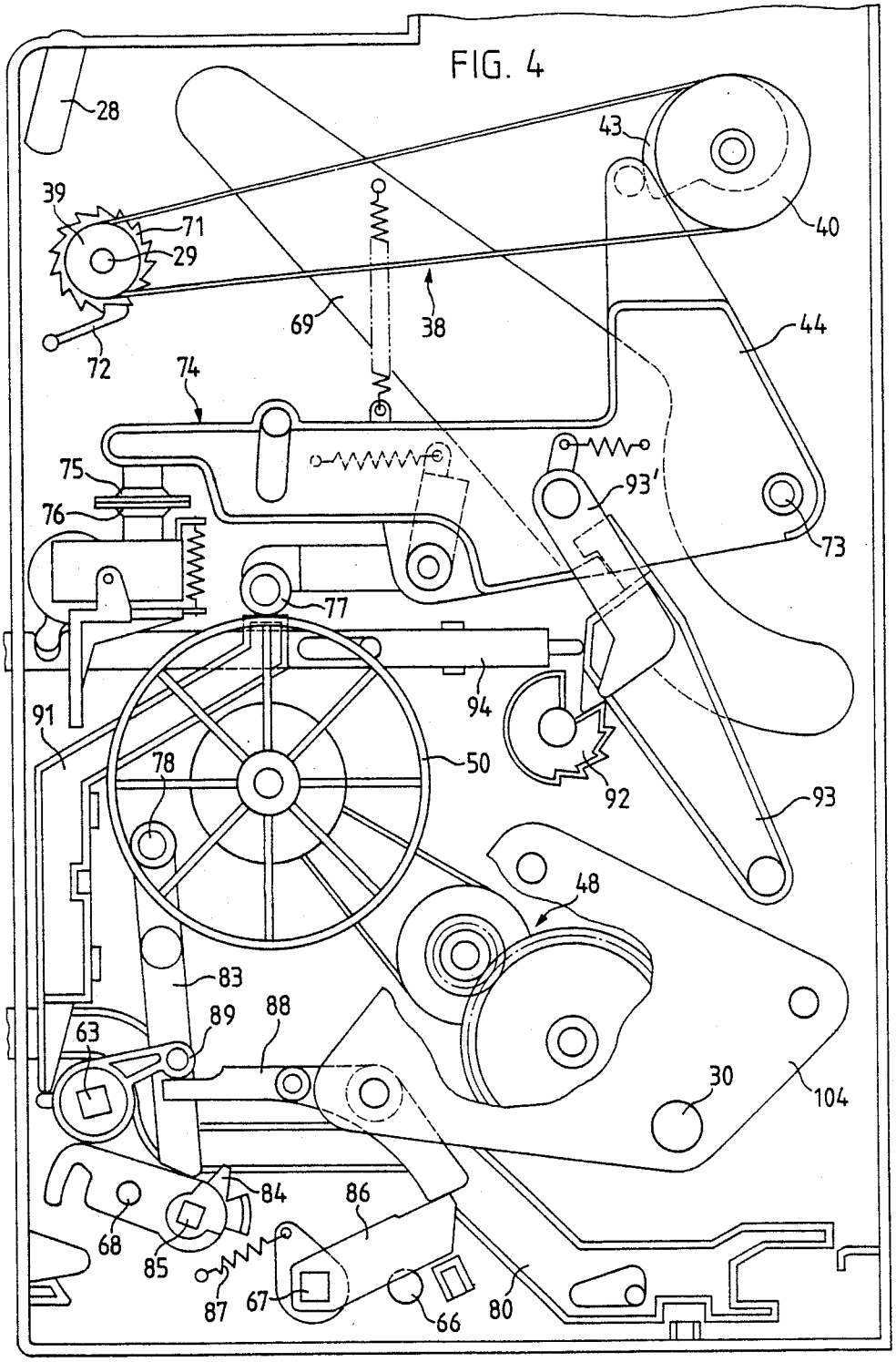
FIG. 4 is a diagrammatic exploded view of further essential inner parts of the towel unit and showing another side wall of the casing of the unit.

FIG. 4 is an exploded perspective view of the inner parts of the towel unit positioned at the casing wall 12. On the delivery shaft 29 is located a ratchet wheel 71, which by cooperation with a resilient pawl 72 prevents the backwards rotation of delivery shaft 29. Connected by means of slip clutch 37, the driving pinion 39 of envelope drive 38 is also located on shaft 29. Driving pinion 39 drives the driven gear 40, on whose shaft is located the cam disk 43. Pawl 44 represents part of a swing arm 74 which can be swung around a spindle 73 and which carries a suction cup 75 and a brake pulley or roll 77. On extracting towel 7 for forming loop 8, the suction cup 75 is pressed by the cam disk 43 onto suction cup 76 and simultaneously the extraction of towel is blocked by pawl 44. At the end of a set time, the two suction cups 75 and 76 separate, so that the brake wheel 50 is freed from the action of brake pulley 77. The cam disk 43 is released, so that the drawing in of the extracted loop 8 starts through the spring tension accumulator 36 in draw-in shaft 30. The drawing in of loop 8 leads to the multi-step gear 48 being set into motion by the draw-in shaft 30 and the brake wheel 50 is accelerated. When the cups are pressed together, brake pulley 77 presses on brake wheel 50 and prevents a movement of draw-in shaft 30. If cover 5,6 is opened, a second brake pulley 78 engages on brake wheel 50 and prevents the rotation of draw-in roller 25 and therefore the release of the spring tension accumulator 36. Brake pulley 78 is positioned above a locking rod 80 corresponding to locking rod 65 and with which is located the bottom flap 81 pivotable about spindle 66 and an opening cover 5, 6 prevents the closing thereof. Brake pulley 78 is mounted on a pivoted lever 83, which extends into the vicinity of the locking shaft 85 carrying the locking hook 68 and is controlled by a cam 84 positioned on said shaft.

FIGS. 5 and 6 show the function of signal flap 10 and the bottom flap 81, pivotable about spindle 66 and positioned behind the same. At its free end the bottom flap 81 has a rotary roll 82 about which is guided the used towel 7. The bottom flap 81 is held in its working position by the locking rods 65, 80. As soon as cover 5, 6 is opened, the bottom flap 81 is unlocked in the vicinity of the rotary roll. The locking rods 65, 80 move in the direction of the cover, which can only be closed again when the rotary roll 82 of bottom flap 81 is brought into its operating position.

In FIG. 5 the signal flap 10 forms part of the bottom and cannot be seen. Thus, cf. FIG. 1, the towel unit 3 is ready to operate, but has not yet been used. At the time of its first use, the signal flap 10 pivots into the position shown in FIG. 6. Signal flap 10 is pivotably mounted on shaft 67, while the latter is held in position by means of a lever 86 through a two-armed lever 88, in which a spring 87 exerts a pivoting force on lever 86. Two-armed lever 88 is in operative connection with a lever 89 fixed to the sensor shaft 63, as shown in FIG. 4.

FIGS. 5 and 6 show the sensor shaft 63 with its sensor rake 90. For as long as the cloth towel 7 covers the sensor rake 90, lever 89 has a position in which the two-armed 88 keeps lever 86 of the signal flap shaft 67 in the fixed position. As soon as the end of towel 7 has passed the sensor rake, under the action of spring 64, cf. FIG. 3, sensor shaft 63 with sensor rake 90 pivots against cover 5, 6, in which are provided means for the passage of the rake members. Thus, the two-armed lever 88 is pivoted by lever 89, so that lever 86 pivots the signal flap shaft 67 counterclockwise. This pivoting movement is utilized in order to bring the adjacent towel unit 3 out of the readiness position shown in FIG. 5 into the operating position through the swinging out of signal flap 10. This can be realized in simple manner by a square tube, which is located on a square member at the end of the signal flap shaft 67. There is no need for any further connection to towel unit 3.

Both towel unit 2 and towel unit 3 can be individually operated. It is merely necessary to use the the particular cover. Only in the case of a joint arrangement are said covers replaced by the transition frame 4 and simultaneously the coupling of the two signal flap shafts 67 takes place by the connecting tube. On swinging out the sensor shaft 63 a push rod 91 is simultaneously raised, so that the brake pulley 77 is raised and brake wheel 50 can be put into movement by the spring tension accumulator 36, so that the towel end is drawn into the draw-in point.

Assistance when inserting a clean towel is provided roughly in the center of the casing wall 12 shown in FIG. 4 by a ratchet wheel 92, a spring-loaded pawl 93 cooperating with said ratchet wheel and a thrust rod 94. On opening the cover the thrust rod 94 is moved forwards, so that the pawl 93 engages in ratchet wheel 92. If the start of the new material belt is passed over the delivery roller 20 and the belt pulled out in order to place the end round the mandrel 26 of the draw-in point E, the cam disk 43 is also rotated. During each rotation it moves the pivoted arm 74, so that the pawl 93 is moved out of the ratchet wheel 92 and the latter is rotated by one tooth through a further pawl 93, After traversing the e.g. five teeth, the pawl 93 blocks the pivoted arm 74, cf. FIG. 4. The unwound cloth length is sufficient for the insertion of the start of the belt round the mandrel 26 and consequently need not be measured. If force is used to bringabout further rotation, the slip clutch 37 comes into operation and prevents any interference with the dispenser. Thus, this not only facilitates the insertion of a clean towel, but prevents damage to the dispenser as a result of incorrect insertion of the use of force.

The section through the draw-in shaft 25 shown in FIG. 7 shows at the left-hand side, i.e. the vicinity of casing wall 11, the driven gear 34, disk 59, 60 of the locking mechanism 58 and a cover wall 95, which is omitted in FIG. 4. The driven gear 34 is located on the draw-in shaft 30, which extends roughly over the center of the draw-in roller 25. At this point a casing part 96 of the spring tension accumulator 36 is fixed to the draw-in shaft 30.

The draw-in roller 25 comprises two cylindrical parts 98, 99 which are interconnected by a coupling part 97, which also forms the other casing part of the spring tension accumulator 36. In the vicinity of the driven wheel 35 in place of slip clutch 31 is incorporated in delivery shaft 29 a slip clutch 100, which comprises an outer casing 101 and an inner casing 102 and between the two casing parts 101, 102 is inserted a drag spring 103. Slip clutches 31, 37, 100 are appropriately known slip springs, which slip or slide through on reaching the limit torque. In the same way the spring tension accumulator 36 is a driving spring, which is constructed as a slip spring. Through the incorporation of slip clutches and the spring tension accumulator of this type, incorrect manipulations and forcible operation of the dispenser are largely avoided.

To the right-handside of draw-in roller 25, i.e. in the vicinity of casing wall 12, it is possible to see part of the multi-step gear 48, by means of which the brake wheel 50 is driven. Gear 48 is provided with a cover 104, which is omitted in FIG. 4.

The described cloth towel dispenser 1 ensures an uninterrupted towel service, provided that the towel roll is changed in good time, i.e. when the other towel unit is in operation. It is easy and fast to replace the rolls.

While the invention has been described with detailed reference to the drawings, it will be obvious to those skilled in the art that many modifications and changes can be made within the scope and sphere of the invention as defined in the claims which follow.

What is claimed is:

1. A cloth towel dispenser incorporating at least one towel unit, said unit comprising:

a first delivery station supporting a clean towel roll having a horizontal axis, the towel roll having a leading feed edge and being adapted to be freely rolled in successive portions, the first station including a pressure roller and a delivery roller receiving a towel cloth from said roll and being rotatable about a horizontal axis and disposed adjacent said pressure roller to guide therebetween a towel cloth upon unrolling said roll;

a second draw-in station spaced below the first station and including a take-up roller freely rotatable about a horizontal axis, and a draw-in roller rotatable about a horizontal axis to retract the successive portions of the roll onto the take-up roller, the leading edge of the roll passing in a manually extractable loop from the first station to the second station along a path which extends downwardly from the first station to a position of use disposed below the second station and then extends upwardly to the second station;

driving means including a gearing operatively connected to said delivery roll, and a spring tension accumulator connected to said gearing and also to said draw-in roller for rotatably interconnecting the delivery roller and the draw-in roller whereby the delivery and draw-in rollers rotate in the same forward direction; said accumulator being tensioned by rotation of said delivery roller during and after the formation of the loop for drawing in a used loop by a spring energy stored in said accumulator; and a slip clutch connected to said draw-in roller for permitting the draw-in roller to rotate in a reverse direction to allow the towel cloth to be unrolled from said take-up roller during formation of the loop, 2. The dispenser of claim 1 and further including timing means to adjust a selected period of time after which the loop is drawn in at the draw-in station.

3. The dispenser of claim 1, wherein said at least one towel unit includes a casing in which the first and second stations and the drive means are disposed, the casing having a removable cover.

4. The dispenser of claim 3, wherein the draw-in roller is hollow, said accumulator being incorporated in an interior of the draw-in roller.

5. The dispenser of claim 4, and further including ratchet means for preventing the delivery roller from rotating in reverse direction.

6. The dispenser of claim 4, wherein said draw-in roller includes a draw-in shaft, said accumulator including an accumulator spring connected to one end of said draw-in shaft, said draw-in roller being connected to another end of said draw-in shaft.

7. The dispenser of claim 3, wherein a signal flap is mounted in rotary manner under spring tension on a bottom of the casing, the flap being concealed when the clean towel roll is first disposed in position and being moved into visible position after said roll has been completely rolled up onto the take-up roller.

8. The dispenser of claim 7, wherein the flap has two sections interconnected by a pivot pin, one section being fixedly secured to the pin and being connected to another section by a releasable locking connection.

9. The dispenser of claim 3, wherein a locking mechanism is provided so that when the cover is removed to permit insertion of a new towel roll, the locking mechanism is actuated to permit unrolling of only enough cloth to form the loop with the leading edge of the roll engaging the draw-in roller.

10. The dispenser of claim 1, wherein the delivery roller and the draw-in roller are of different diameters so that during operation the delivery roller has a speed of rotation which is lower than the speed of rotation of the draw-in roller, the slip clutch permitting compensation of a difference in speeds of rotation between said delivery roller and said draw-in roller.

11. The dispenser of claim 1 and further including an additional slip clutch and a locking mechanism associated with the draw-in roller to limit a return path of said draw-in roller in said inverse direction and thereby to limit the length of a portion of the cloth retractable from the take-up roller.

12. The dispenser of claim 11, wherein the locking mechanism is constructed as a Maltese cross device and has a first disk with a cam driven by the draw-in roller and which meshes with an engaging temporarily stationary second disk having a groove for receiving the cam in such a manner that when the second disk is stationary, the first disk is locked only after at least one rotation.

13. The dispenser of claim 1 and further including a rotatable gear and a further slip clutch rotatably connecting the rotatable gear to the delivery roller, the dispenser further including a cam disk and a pawl, said cam disk, after occurrence of a selected number of rotations of the delivery roller, striking against the pawl to lock the delivery roller and the draw-in roller to prevent further rotation thereof.

* * * * *

UNITED STATES PATENT AND TRADEMARK OFFICE

CERTIFICATE OF CORRECTION

PATENT NO. : 4,818,042

DATED : April 4, 1989

INVENTOR(S) : SANDRO ARABIAN and MANFRED BAUMAN

It is certified that error appears in the above-identified patent and that said Letters Patent is hereby corrected as shown below:

On the Title Page (Page 1), add the following:

[30] Foreign application priority data
September 26, 1986[ch] Switzerland... 3862/86

Signed and Sealed this

Fifth Day of September, 1989

*Attest:*

DONALD J. QUIGG

*Attesting Officer*

*Commissioner of Patents and Trademarks*